US005606783A

United States Patent [19]

Gillis et al.

[11] Patent Number: 5,606,783

[45] Date of Patent: Mar. 4, 1997

[54] BUCKLE FOR VEHICLE SEAT BELT SYSTEM

[75] Inventors: Kevin M. Gillis, St. Clair; Gregory D. Heyboer, Rochester Hills, both of Mich.

[73] Assignee: TRW Vehicle Safety Systems Inc., Lyndhurst, Ohio

[21] Appl. No.: 527,030

[22] Filed: Sep. 12, 1995

[51] Int. Cl.[6] ..... A44B 11/26

[52] U.S. Cl. ..... 24/632; 24/628; 24/637; 297/478

[58] Field of Search ..... 24/573.5, 628, 24/632, 633, 642, 637, 662; 297/468, 476

[56] References Cited

U.S. PATENT DOCUMENTS

| | | | |
|---|---|---|---|
| 4,457,052 | 7/1984 | Hauber | 24/664 X |
| 4,644,618 | 2/1987 | Holmberg et al. | 24/632 X |
| 4,646,400 | 3/1987 | Tanaka | 24/632 |
| 4,757,579 | 7/1988 | Nishino et al. | 24/637 X |
| 5,023,981 | 6/1991 | Anthony et al. | 24/573.5 |
| 5,086,548 | 2/1992 | Tanaka et al. | 24/632 |
| 5,142,748 | 9/1992 | Anthony et al. | 24/632 X |
| 5,182,837 | 2/1993 | Anthony et al. | 24/632 X |
| 5,220,713 | 6/1993 | Lane, Jr. et al. | 24/628 |
| 5,267,377 | 12/1993 | Gillis et al. | 24/632 X |
| 5,269,051 | 12/1993 | McFalls | 24/632 |
| 5,283,933 | 2/1994 | Wiseman et al. | 24/642 |
| 5,398,997 | 3/1995 | McFalls | 297/476 |

*Primary Examiner*—Peter M. Cuomo
*Assistant Examiner*—Robert J. Sandy
*Attorney, Agent, or Firm*—Tarolli, Sundheim, Covell, Tummino & Szabo

[57] ABSTRACT

A seat belt buckle (24) includes a base (80) that defines a cavity (82) for receiving a pair of tongues (62, 64). A latch plate (100) is supported by the base (80) and is movable between a first position connecting the tongues (62, 64) with the base when the tongues are advanced a fully inserted distance into the cavity (82) and a second position at which the tongues are disconnected from the base. A blocking mechanism (200) has a portion located in a path of movement (P1, P2) of one of the tongues (62, 64). The blocking mechanism (200) is operable to block advancement of the tongues (62, 64) the fully inserted distance into the cavity (82) until both tongues are advanced into the cavity together a predetermined distance. The blocking mechanism (200) comprises a member (204) that is linear moveable relative to the base (80). A pivotable arm (206) carried by the member (204) has opposite end portions (266, 264) which engage the tongues (62, 64). The arm pivots relative to the member (204) when one of the tongues (62, 64) is advanced a predetermined distance into the cavity (82) ahead of the other tongue. Stops (226, 228) supported by the base (80) engage the end portions (262, 264) of the arm (206) to limit pivoting of the arm and to block movement of the member (204) and thereby block movement of the tongues (62, 64) the fully inserted distance into the cavity (82).

19 Claims, 6 Drawing Sheets

BUCKLE FOR VEHICLE SEAT BELT SYSTEM

BACKGROUND OF THE INVENTION

1. Technical Field

The present invention relates to a buckle, and particularly to a buckle in a vehicle seat belt system for a child's seat.

2. Description of the Prior Art

A known seat belt system for a child's seat includes a buckle that is attached to an end of a crotch belt. The seat belt system also includes a pair of shoulder belts which extend across the shoulders and hips of a child occupying the seat. Each shoulder belt carries a tongue. The tongues are inserted into the buckle and latched to connect the crotch belt with the shoulder belts.

SUMMARY OF THE INVENTION

The present invention is directed to an apparatus in a vehicle seat belt system for a child's seat. The apparatus includes first and second tongues. A base has a longitudinal axis and at least partially defines a cavity for receiving the tongues. The first and second tongues are movable along respective first and second paths of movement. Latch means supported by the base moves between a first position connecting the tongues with the base when the tongues are moved a fully inserted distance into the cavity and a second position in which the tongues can disconnect from the base. Blocking means has a portion located in a path of movement of at least one of the tongues. The blocking means is operable to block movement of just one tongue into the cavity the fully inserted distance until both of the tongues move a predetermined distance into the cavity.

The blocking means comprises a member which is supported for movement relative to the base. A pivotable arm is carried by the member and has opposite end portions. The end portions of the arm are engageable with the tongues. The arm pivots relative to the member upon one of the tongues moving the predetermined distance into the cavity without the other of the tongues being moved the predetermined distance into the cavity. Stops engage one of the end portions of the arm to limit pivoting movement of the arm and block movement of the member which prevents movement of only one tongue the fully inserted distance into the cavity.

Each of the tongues includes a plate portion and a protrusion. The plate portions cooperate with the latch means to connect the tongues with the base. The protrusions engage a respective end portion of the arm. Each protrusion extends in a direction substantially parallel to and offset from a plane containing an associated plate portion. Each of the first and second paths of movement of the tongues extends in a direction substantially parallel to the longitudinal axis of said base.

The member and the arm are located on a side of the base opposite the side of the base where the latch means is located. The member is linearly movable in opposite directions extending substantially parallel to the longitudinal axis of the base as the tongues are advanced into the cavity. A housing is attached to the base. The stops are formed on the housing. The housing also has a channel for receiving the member.

The pivotable arm has a first position relative to the member enabling movement of the tongues the fully inserted distance into the cavity. The arm has a second position relative to the member blocking movement of the tongues into said cavity in response to one tongue moving into the cavity a predetermined distance ahead of the other tongue. The blocking means thus blocks insertion of the tongues into the cavity until both tongues are advanced together the predetermined distance into the cavity.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF PREFERRED EMBODIMENT

Figure 1:
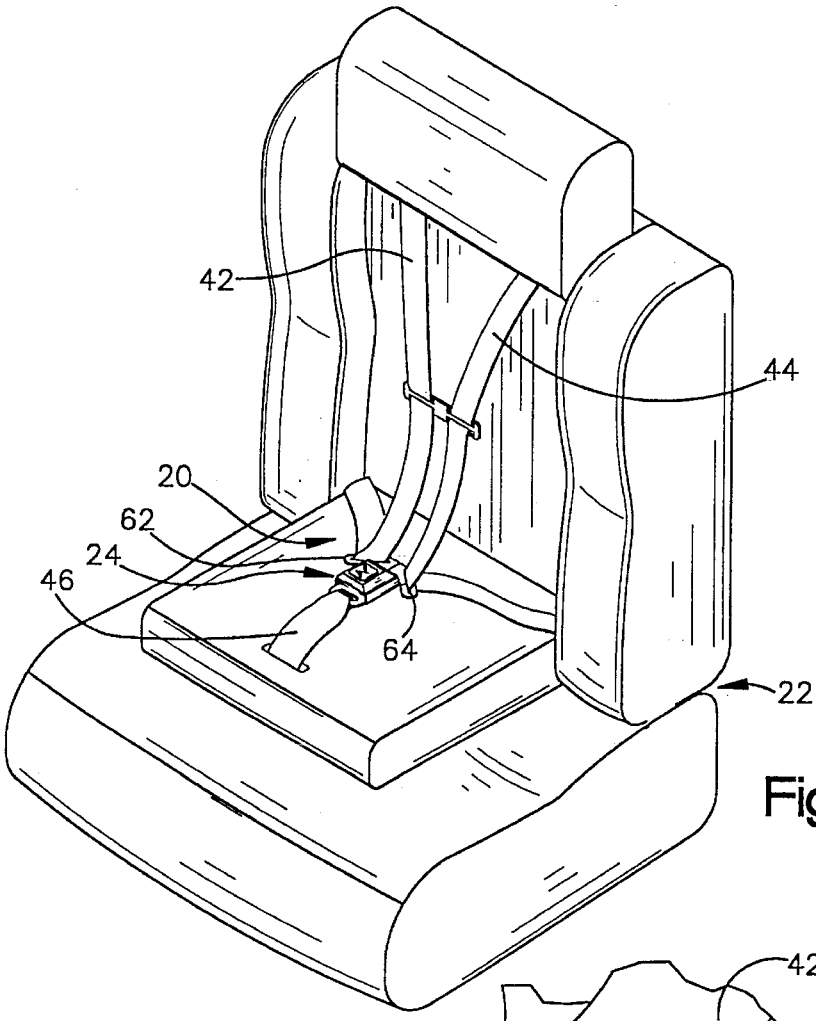
FIG. 1 is a perspective view of a seat and a seat belt system having a buckle embodying the present invention.
Figure 2:
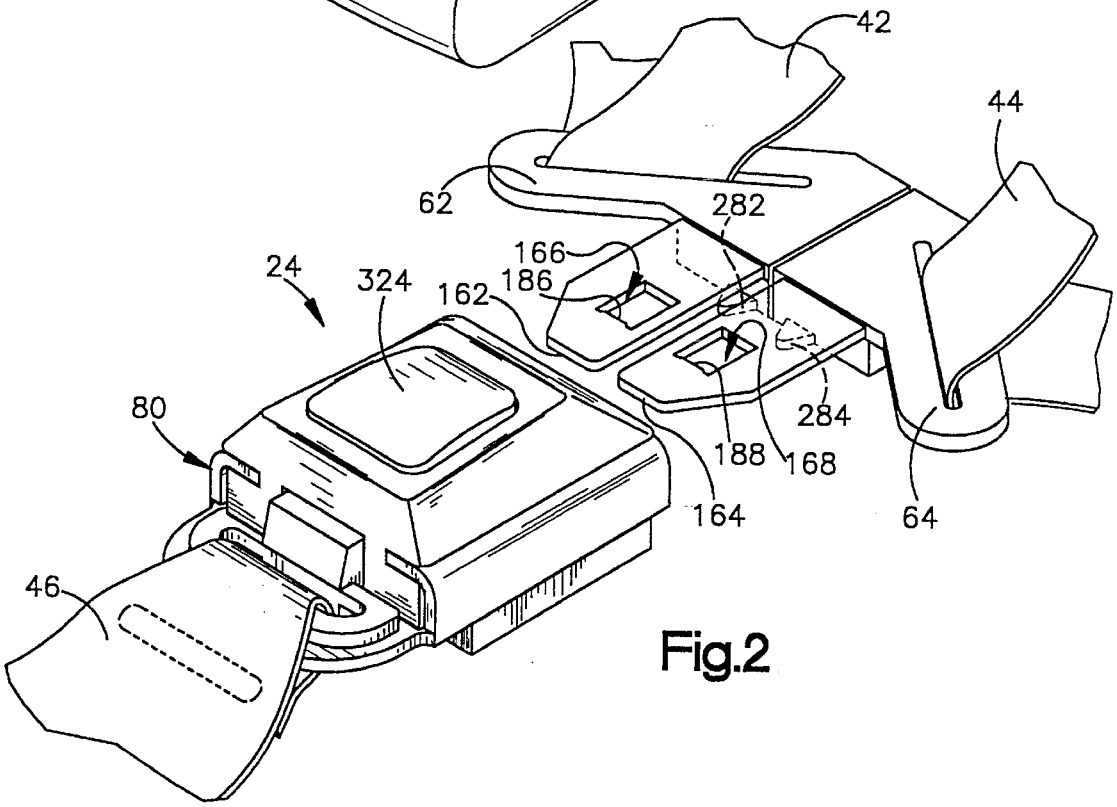
FIG. 2 is an enlarged perspective view of the buckle of FIG. 1 and a pair of tongues of the seat belt system.

A seat belt system 20 for a vehicle child's seat 22, is illustrated in FIG. 1. The seat belt system 20 includes a buckle 24, embodying the present invention. The seat belt system 20 also includes a pair of shoulder belts 42, 44 and a crotch belt 46. The buckle 24 (FIG. 2) is attached to the crotch belt 46. The shoulder belt 42 is trained through a slot in a first tongue 62. The shoulder belt 44 is trained through a slot in a second tongue 64.

Figure 4:
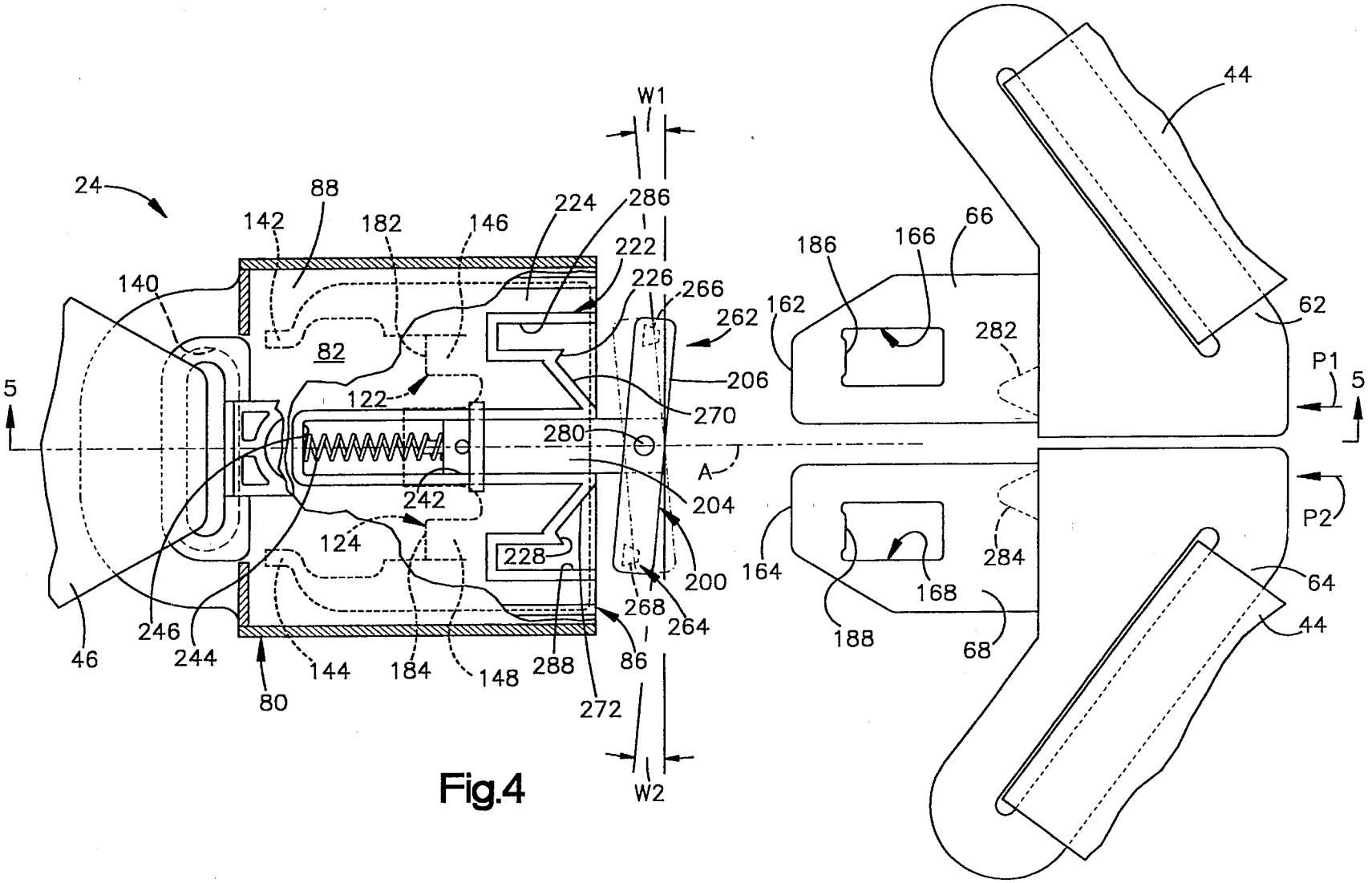
FIG. 4 is a plan view of the buckle of FIG. 3 prior to receiving the tongues with some parts of the buckle broken away for clarity and some parts sectioned.

The first tongue 62 includes a plate portion 66 (FIG. 4). The second tongue 64 includes a plate portion 68. The buckle 22 receives the plate portions 66, 68 of the tongues 62, 64 to connect the shoulder belts 42, 44 with the crotch belt 46.

Figure 3:
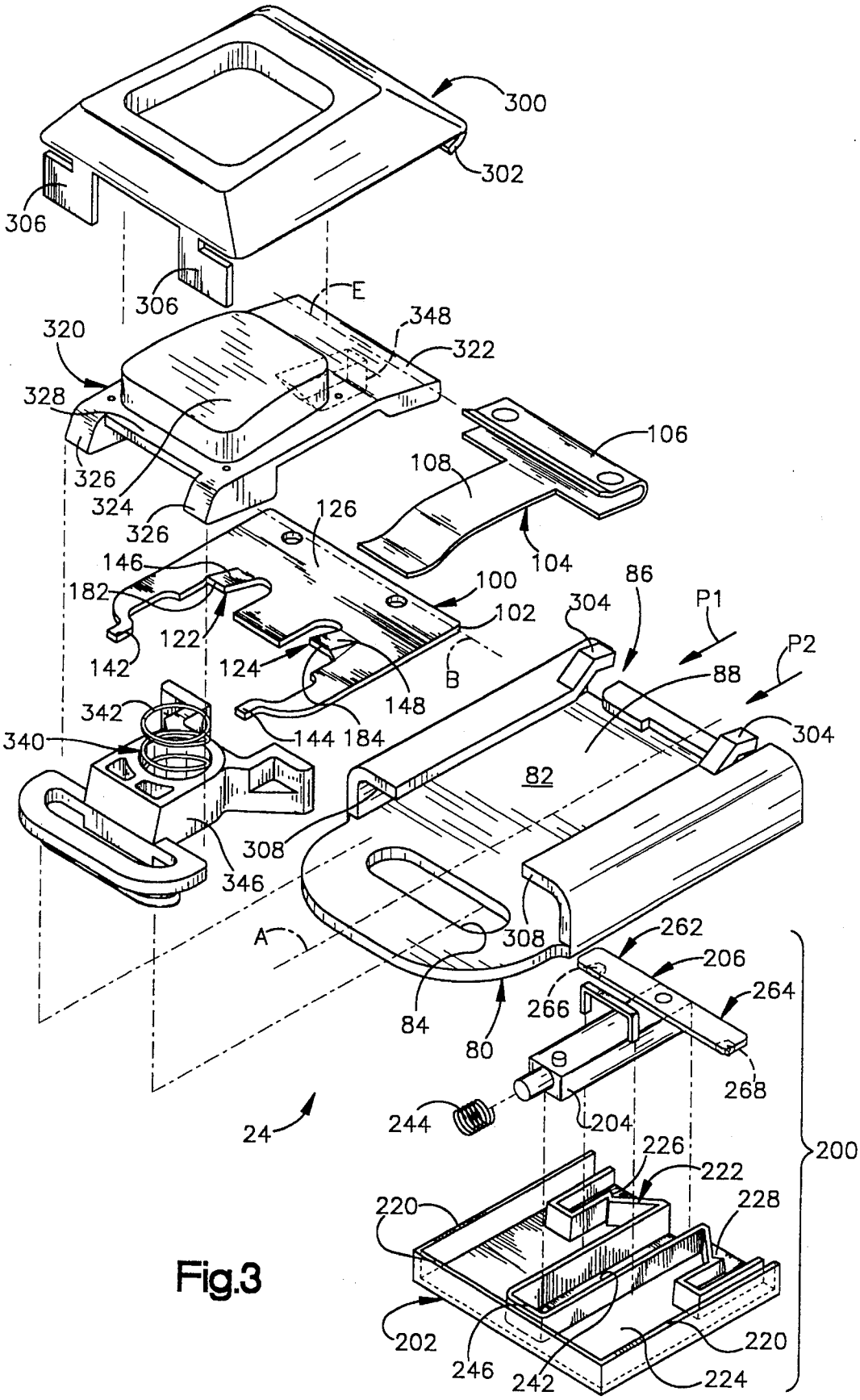
FIG. 3 is an enlarged exploded perspective view of the buckle of FIG. 2.

The buckle 24 (FIGS. 2–5) includes a metal base 80 with a longitudinal central axis A (FIGS. 3 and 4). The base 80 at least partially defines a cavity 82 in the buckle 24 for receiving the plate portions 66, 68 of the tongues 62, 64. A slot 84 in an end portion of the base 80 receives an end loop of the crotch belt 46 (FIG. 3). An entrance opening 86 to the cavity 82 in the buckle 24 is located at an end of the base 80 which is axially opposite the slot 84. The base 80 also includes a substantially planar floor 88.

The tongues 62, 64 are movable along respective paths of movement P1, P2 into the buckle 24 through the entrance opening 86. The paths of movement P1, P2 are parallel to the axis A of the base 80. The plate portions 66, 68 of the tongues 62, 64 are movable a fully inserted distance along the paths of movement P1, P2 into the cavity 82 in the buckle 24.

A metal latch plate 100 (FIGS. 3 and 4) is supported by the floor 88 of the base 80 and pivots at an end 102 about an axis B. The end 102 of the latch plate 100 is supported by the base 80 at a location adjacent to the entrance opening 86. The latch plate 100 is pivotable between a latched position and a release position. When the latch plate 100 is in the latched position and the plate portions 66, 68 of the tongues 62, 64 are moved the fully inserted distance into the cavity 82, the tongues are connected with the base 80. When the latch plate 100 is in the release position, the tongues 62, 64 are not connected with the base 80. Withdrawal of the tongues 62, 64 from the buckle 24 is thus permitted in a direction to the right, as viewed in FIGS. 4–9.

Figure 5:
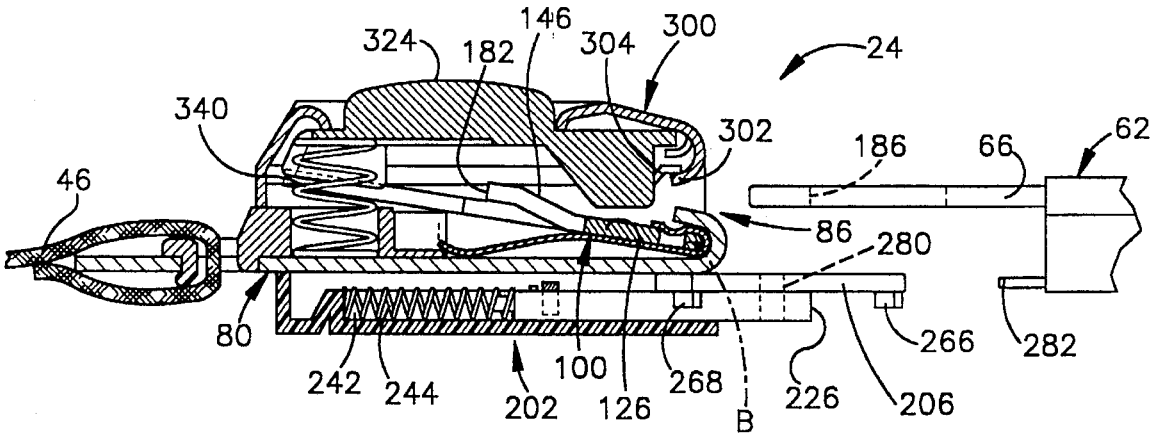
FIG. 5 is a sectional view of the buckle of FIG. 4 taken approximately along the line 5—5 in FIG. 4.
Figure 9:
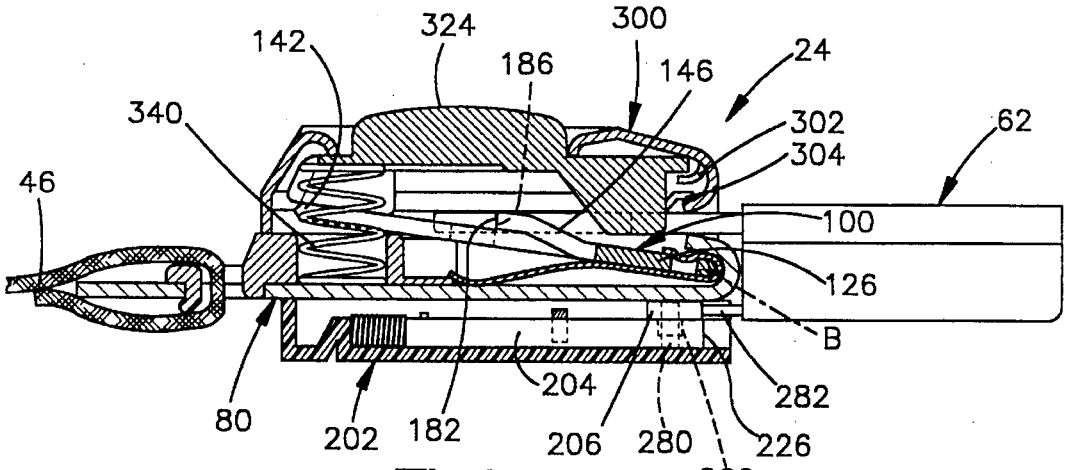
FIG. 9 is a sectional view of the buckle of FIG. 8, taken approximately along the line 9—9 in FIG. 8.

A spring 104 (FIG. 3) biases the latch plate 100 to pivot clockwise about the axis B, as viewed in FIGS. 5 and 9, in a direction away from the floor 88 of the base 80 toward the latched position. A mounting portion 106 of the spring 104 is attached to the end 102 of the latch plate 100. A finger 108 of the spring 104 extends from the mounting portion 106 and engages the floor 88 of the base 80, as viewed in FIG. 5, to bias the latch plate 100 to pivot in a direction away from the floor of the base.

The latch plate 100 has a pair of stamped latch lugs 122, 124 projecting upward, as viewed in FIG. 3, from a planar main portion 126 of the latch plate. The latch lugs 122, 124 are laterally spaced relative to the middle of the latch plate 100, which is located along the axis A of the base 80, as viewed in FIG. 4. The latch plate 100 also has a pair of wing members 142, 144 which are laterally spaced from the middle of the latch plate 100. The wing members 142, 144 are located in a plane which contains the planar main portion 126 of the latch plate 100.

Figure 6:
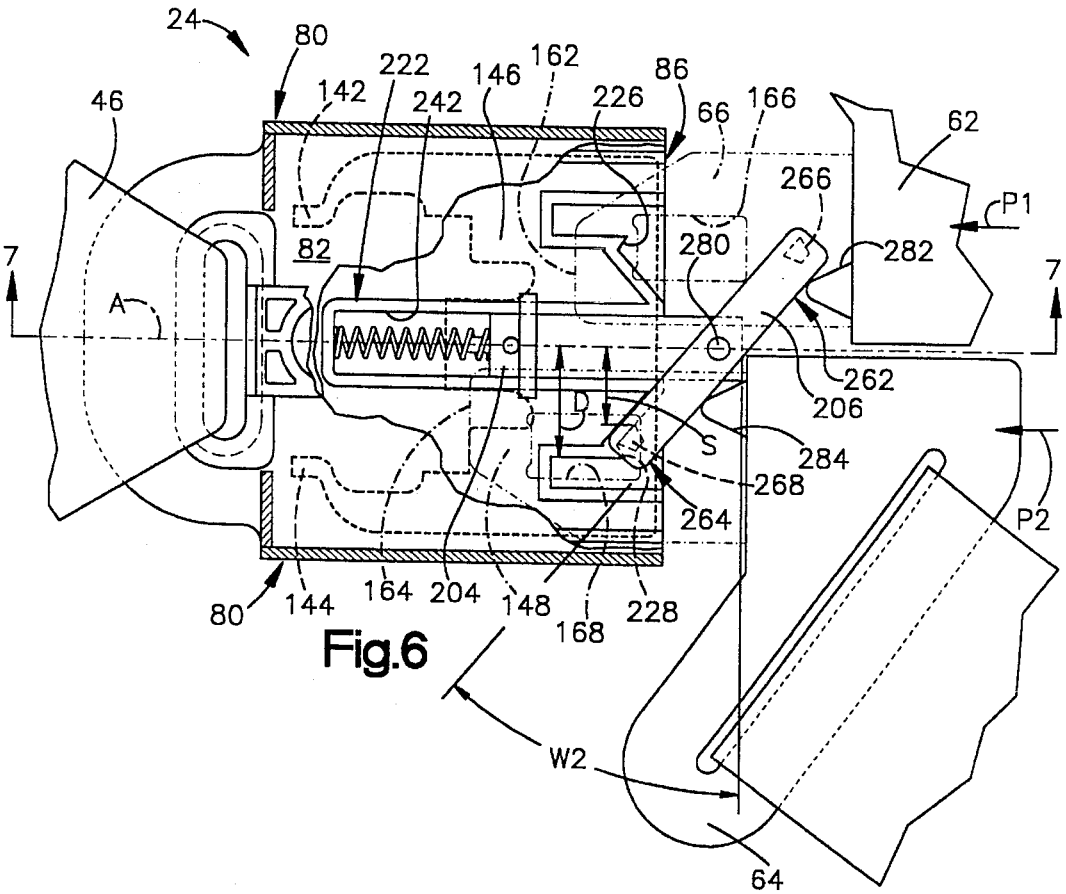
FIG. 6 is a view similar to FIG. 4 with parts illustrated in different positions.
Figure 7:
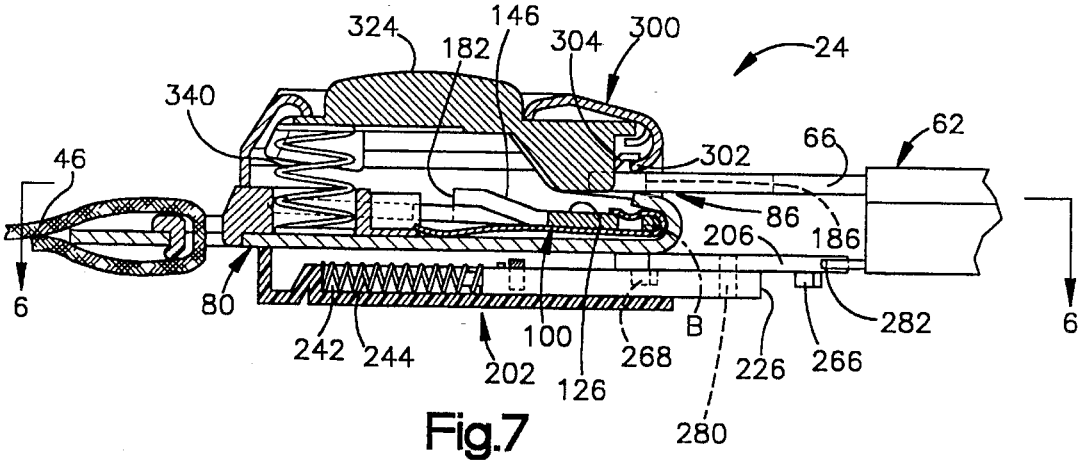
FIG. 7 is a sectional view of the buckle of FIG. 6, taken approximately along the line 7—7 in FIG. 6.

Each of the latch lugs 122, 124 has a respective cam surface 146, 148 disposed at an angle relative to the planar main portion 126 of the latch plate 100, as illustrated in FIG. 5. The cam surfaces 146, 148 face the entrance opening 86 of the buckle 24. The cam surfaces 146, 148 engage a respective leading edge 162, 164 of the plate portions 66, 68, as illustrated in FIG. 6. As the plate portions 66, 68 of the tongues 62, 64 move into the cavity 82 of the buckle 24, the latch plate 100 pivots in a counterclockwise direction about the axis B, as viewed in FIG. 7, toward the floor 88 of the base 80.

Figure 8:
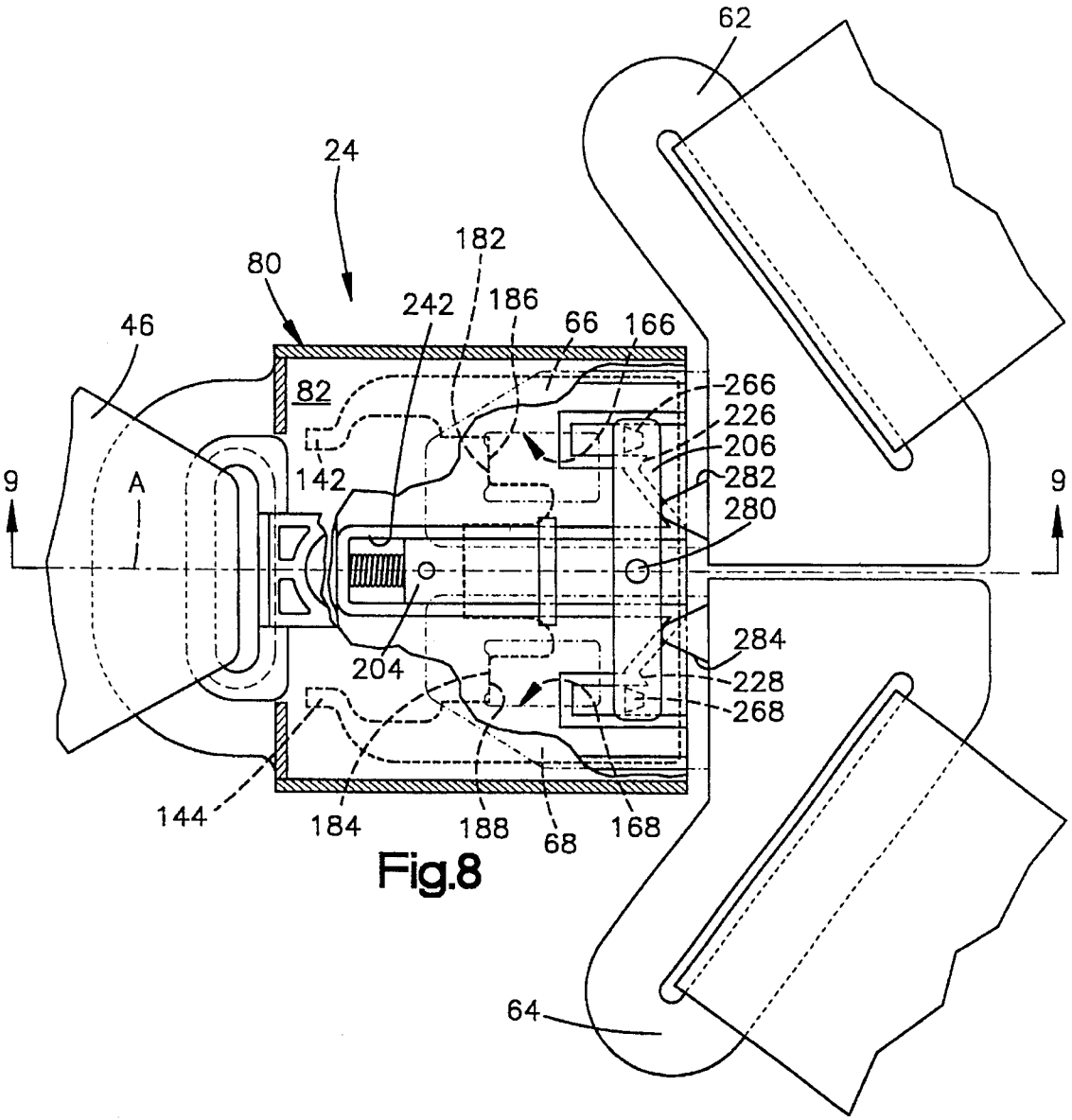
FIG. 8 is a view similar to FIGS. 4 and 6 with parts illustrated in different positions.

When the plate portions 66, 68 of the tongues 62, 64 are moved the fully inserted distance into the cavity 82, the latch plate 100 pivots to the latched position by the biasing force of the spring 104. The latch lugs 122, 124 of the latch plate 100 enter latch openings 166, 168 in the plate portions 66, 68 of the tongues 62, 64 to connect the tongues with the base 80, as illustrated in FIGS. 8 and 9. End surfaces 182, 184 of the latch lugs 122, 124 engage respective end surfaces 186, 188 that partially define the openings 166, 168 in the plate portions 66, 68. Engagement between the end surfaces 182, 184 of the latch lugs 122, 124 and the end surfaces 186, 188 of the plate portions 66, 68 prevents withdrawal of the tongues 62, 64 from the cavity 82 in the buckle 24.

A cover 300 (FIG. 7) is secured to the base 80 by a lip 302 on an end of the cover engaged by laterally spaced tangs 304 on the base and by tabs 306 at the opposite end of the cover being snapped over end surfaces 308 of the base. A one-piece molded plastic pushbutton 320 is pivotably supported by the cover 300. The pushbutton 320 has an end portion 322 which pivotally engages the lip 302 on the cover 300. The pushbutton 320 pivots about an axis E which extends through the end portion 322 in a direction substantially parallel to the axis B of the latch plate 100. The pushbutton 320 extends in a direction substantially parallel to the base 80.

The pushbutton 320 moves the latch plate 100 from the latched position to the release position. The pushbutton 320 has a manually engageable button surface 324 and two downwardly depending actuator lugs 326 (FIGS. 3 and 5) on an end portion 328 which is located axially opposite the end portion 322 about which the pushbutton pivots. The actuator lugs 326 are located on laterally spaced sides of the pushbutton 320 relative to the middle of the pushbutton which extends along axis A of the base 80.

In response to the button surface 324 being manually engaged and depressed, the pushbutton 320 pivots counterclockwise about the axis E, as viewed in FIG. 5, and the actuator lugs 326 contact the wing members 142, 144 of the latch plate 100. The actuator lugs 326 transmit downward or counterclockwise pivotal movement of the pushbutton 320 to the wing members 142, 144 of the latch plate 100. The wing members 142, 144 pivot the latch plate 100 counterclockwise about the end portion 102 to the release position at which the tongues 62, 64 are no longer connected to the base 80 by the latch plate.

A coil spring 340 urges the pushbutton 320 to the raised or unactuated position in a direction away from the base 80, as illustrated in FIG. 5, when the force depressing the pushbutton is released. At an upper end 342, the coil spring 340 engages the end portion 328 of the pushbutton 320. At a lower end, the coil spring 340 engages a spring holder 346 attached to the base 80. The coil spring 340 and spring holder 346 are located between the wing members 142, 144 of the latch plate 100 and between the actuator lugs 326 of the pushbutton 320.

A divider member 348 (FIGS. 3 and 5) is formed in one piece with the pushbutton 320 and extends downwardly from the pivot end portion 322 near the entrance opening 86 of the buckle 24. The divider member 348 divides the entrance opening 86 of the buckle 24 substantially in half. The divider member 348 defines one side of the path of movement P1 for the first tongue 62 in the cavity 82 and one side of the path of movement P2 for the second tongue 64. The divider member 348 acts to guide the tongues 62, 64 along their respective paths of movement P1, P2 as the tongues are advanced into the cavity 82 in the buckle 24. The divider member 348 also blocks rotational movement of the tongues 62, 64 within the cavity 82 of the buckle 24 about axes extending normal to the base 80.

The buckle 24 includes a blocking mechanism 200 (FIGS. 3, 4 and 5) which is supported by the base 80. The blocking mechanism 200 is operable to block movement of the plate portions 66, 68 the fully inserted distance into the cavity 82 in the buckle 24. When both of the tongues 62, 64 are advanced along the paths of movement P1, P2 to at least a predetermined distance at substantially the same time, the blocking mechanism 200 is ineffective to block movement of the tongues 62, 64 the fully inserted distance into the cavity 82. The predetermined distance is less than the fully inserted distance.

The blocking mechanism 200 includes a housing 202, a plunger 204 and an arm 206. The housing 202 has three upstanding sides 220 which are fixed to a bottom of the base 80 in a suitable manner, such as by welding, adhesive bonding or mechanical attachment. The housing 202 is located on a side of the base 80 opposite the cavity 82 and latch plate 100.

The housing 202 is preferably stamped from metal or molded from plastic. A projection 222 extends upward from a floor 224 of the housing 202. The projection 222 extends a distance from the floor 224 which is less than the distance that the sides 220 extend from the floor.

Figure 4A:
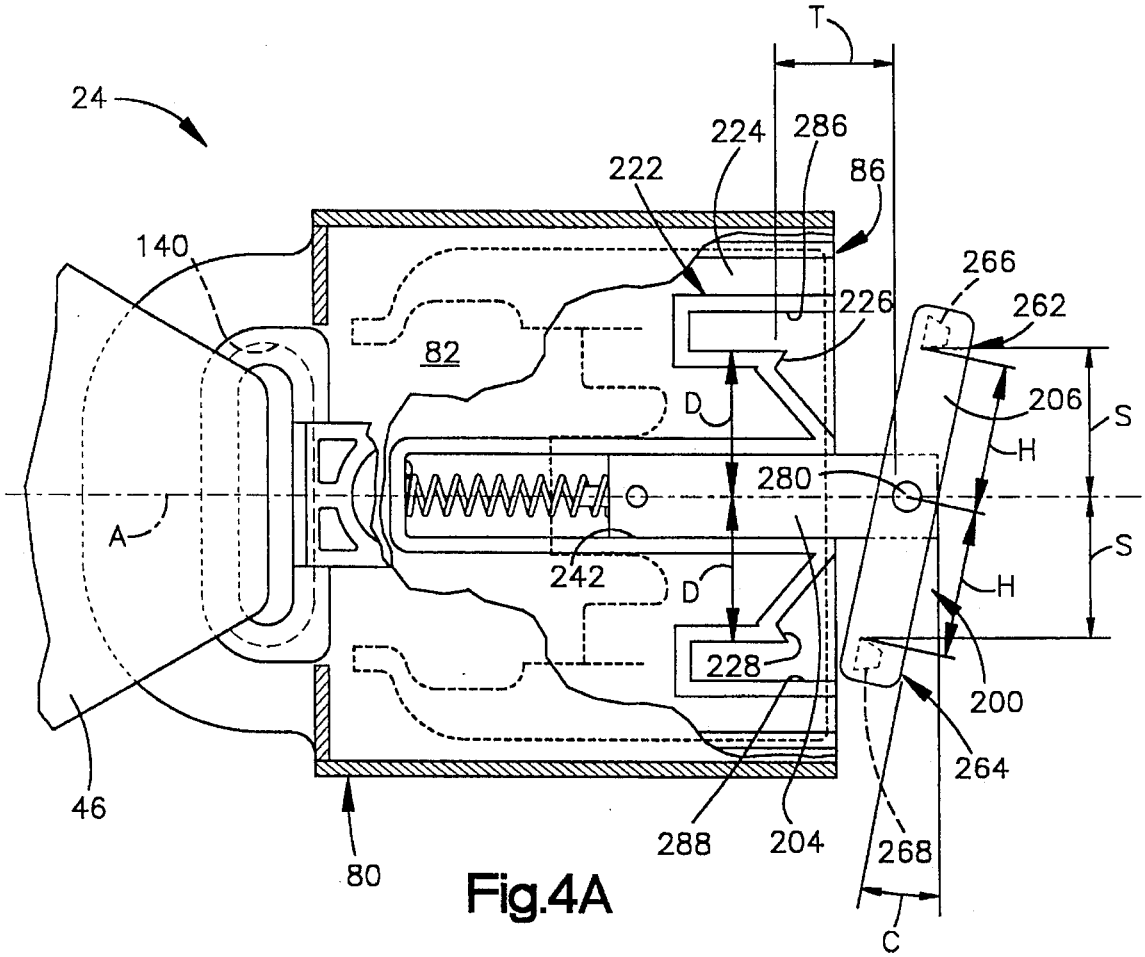
FIG. 4A is a view of the buckle of FIG. 4, illustrating relationships of some of the parts.

The projection 222 of the housing 202 includes a pair of stops 226, 228 located near the right end of the housing, as viewed in FIG. 4, and below the entrance opening 86 of the buckle 24. The stops 226, 228 are laterally spaced the same fixed distance D (FIG. 4A) from the middle of the housing 202, which extends along the axis A of the base 80, as viewed in FIG. 4A. The projection 222 of the housing 202 also defines a channel 242 extending along the middle of the housing.

The plunger 204 is received in the channel 242. The plunger 204 is guided by the portion of the projection 222 that defines the channel 242 for linear movement in opposite directions. A spring 244 engages a wall portion 246 of the projection 222 located at an end of the channel 242 and also engages an end of the plunger 204. The spring 244 biases the plunger 204 to move in a direction away from the wall portion 246 of the projection 222 and out of the channel 242.

The arm 206 is supported on an upwardly facing surface of the plunger 204, as viewed in FIGS. 3 and 5, for pivotal movement relative to the plunger. The arm 206 extends in a direction transverse to the direction of movement of the plunger 204 in channel 242. The arm 206 is located outside of the housing 202, as illustrated in FIGS. 4 and 5, when the tongues 62, 64 are located outside the cavity 82 of the buckle 24. When the plate portions 66, 68 of the tongues 62, 64 are moved into the cavity 82, the arm 206 moves inside the housing 202 into a space located between the base 80 and the projection 222, as illustrated in FIGS. 8–9.

The arm 206 has axially opposite end portions 262, 264. The end portion 262 includes a pin portion 266 which projects downward, as viewed in FIGS. 3 and 5. The end portion 264 includes a pin portion 268 which projects downward. The pin portions 266, 268 are located equal fixed distances H (FIG. 4A) from the center of the pivot 280 about which the arm 206 pivots. The pin portions 266, 268 are located a variable distance S from the axis A. The variable distance S is defined as the fixed distance H from the pivot 208 to one of the pin portions 266 or 268 times the sine of a variable angle W1 or W2 that the arm 206 pivots in either direction relative to the plunger 204 from the orthagonal or neutral initial position relative to the plunger (S=Hsin(W1 or W2)).

When the arm 206 is substantially perpendicular to the plunger 204, the variable distance S that the pin portions 266, 268 are located from the axis A is greater than the fixed distance D to the stops 226, 228. During pivoting of the arm 206, the variable distance S may be less than the fixed distance D. The pin portions 266, 268 engage the stops 226, 228 of the projection 222 in the housing 202 when the variable distance S is less than the fixed distance D. The variable distance S becomes less than the fixed distance D in response to the arm 206 pivoting to the variable angle W1 or W2, (FIG. 4) which is at least equal to a fixed predetermined critical angle C (FIG. 4A) before the plunger 204 moves into the channel 242 a threshold distance T.

The threshold distance T for movement of the plunger 204 is substantially equal to the predetermined distance for movement of the plate portions 66, 68 of the tongues 62, 64. The threshold distance T is defined as a minimum axial movement of the plunger 204 to the left, as viewed in FIG. 9, at which a pin portion 266 or 268 on the arm 206 can no longer engage a stop 226 or 228 on the housing 202. Engagement of a pin portion 266 or 268 and a stop 226 or 228 prevents the plunger 204 from moving into the channel 242 further and thus blocks further advancement of the plate portions 66, 68 of the tongues 62, 64 into the cavity 82 of the buckle 24.

Each of the tongues 62, 64 has a protrusion 282, 284 which is located below, as viewed in FIG. 5, the associated plate portions 66, 68 of the tongues. As the plate portions 66, 68 of the tongues 62, 64 are advanced toward the fully inserted distance into the cavity 82 of the buckle 24, the protrusion 282 or 284 on the tongue which is advanced the farthest engages an end portion 262, 264 of the arm 206. When the protrusion 282 or 284 on the farthest advanced tongue 62 or 64 is advanced a predetermined distance ahead of the other tongue and is engaged with the end portion 262, 264 of the arm 206, further movement of the plate portion 66 or 68 of the farthest advanced tongue into the cavity 82 causes the arm to pivot relative to the plunger 204. One of the pin portions 266 or 268 engages a surface 270 or 272 of the projection 222 adjacent one of the stops 226 or 228 to limit the variable angle W1 or W2 that the arm 206 may pivot relative to the plunger 204. The surfaces 270 or 272 thus assure that the end portions 262, 264 of the arm 206 will always be located in a position to engage a protrusion 282 or 284 of the tongues 62, 64.

When both of the tongues 62, 64 are advanced substantially together into the cavity 82 of the buckle 24, both of the protrusions 282, 284 of the tongues engage the end portions 262 or 264 of the arm 206. The variable angle W1 or W2 of the arm 206 is less than the predetermined critical angle C required for the pin portions 266, 268 to engage a respective stop 226, 228, as viewed in FIG. 6. The arm 206 thus cannot pivot to a position blocking advancement of the tongues 62, 64 because at least one of the pin portions 266, 268 is located axially beyond a respective one of the stops 226, 228. Since the pin portions 266, 268 cannot engage the stops 226, 228 of the housing 202, the tongues 62, 64 may be advanced into the cavity 82 the fully inserted distance. The latch plate 100 may pivot upward under the biasing force of the spring 104 to the latched position, as illustrated in FIG. 9.

When the arm 206 pivots through the variable angle W1 or W2 in either direction which is more than the predetermined critical angle C, one of the pin portions 266, 268 engages an associated stop 226, 228. This occurs prior to the tongues 62, 64 being inserted the predetermined distance and the plunger 204 moving the threshold distance T. The plunger 204 is blocked from further movement into the channel 242. Thus, the tongues 62, 64 are prevented from being advanced the fully inserted distance into the cavity 82 in the buckle 24 until both of the tongues 62, 64 are simultaneously inserted the predetermined distance into the cavity 82 in the buckle 24.

Until both of the tongues 62, 64 are moved substantially the same predetermined distance into the cavity 82 of the buckle 24 at substantially the same time, the arm 206 of the blocking mechanism 200 operates to prevent advancement of both of the tongues further into the cavity of the buckle. A single one of the tongues 62 or 64 cannot be moved the fully inserted distance into the cavity 82 in the buckle 24 and connected to the base 80 by the latch plate 100.

The blocking position of the arm 206 in one direction, as illustrated in FIG. 6, has the arm pivoting to a variable angle W2 which is more than the predetermined critical angle C and the pin portion 268 engages the stop 228. This prevents the second tongue 64 from being advanced the fully inserted distance into the cavity 82 in the buckle 24. When the arm 206 pivots an angle W2 from its neutral position which is less than the predetermined critical angle C, and the plunger 204 has moved more than the threshold distance T, the stop 228 is not engaged and both of the tongues 62, 64 can move further into the cavity 82, as illustrated in FIG. 8. The plate portions 66, 68 of the tongues 62, 64 are allowed to move the fully inserted distance along the paths of movement P1, P2 only when the arm 206 is in its unblocking position.

The blocking position of the arm 206 pivoting in the other direction to a variable angle W1 (FIG. 4) which is more than the predetermined critical angle C, prevents the first tongue 62 from being advanced into the cavity 82 in the buckle 24 to the fully inserted distance until both of the tongues 62, 64 are advanced the predetermined distance into the cavity in the buckle. The tongue 62 is allowed to be advanced along the path of movement P1 to the engaged position only when the arm 206 is in its unblocking position.

If the plunger 204 moves beyond the threshold distance T (FIG. 4A) before a pin portion 266 or 268 engages an associated stop 226 or 228, the pin portions cannot engage the stops and the pin portions move into pin receiving channels 286, 288 (FIGS. 4 and 4A) defined by the projection 222. The channels 286, 288 are laterally spaced from the middle of the housing 202. The blocking mechanism 200 thus is ineffective to prevent the plate portions 66, 68 of the tongues 62, 64 from moving the fully inserted distance into the cavity 82 in the buckle 24. The tongues 62, 64 can then be latched in the buckle 24.

In operation, when an occupant of the seat 22, such as a child, is to be secured in the seat by the seat belt system 20, the shoulder belts 42 and 44 are positioned around the shoulders and hips of the child. The crotch belt 46 is extended upward between the legs of the child. The tongues 62, 64 are advanced into the buckle 24 in front of the child to interconnect the shoulder belts 42, 44 and the crotch belt 46.

To connect the tongues 62, 64 with the buckle 24, the tongues are advanced substantially simultaneously into the cavity 82 in the buckle. Each plate portion 66, 68 of the tongues 62, 64 is inserted along a respective path of movement P1, P2 into the entrance opening 86 of the buckle 24 at substantially the same time. During advancement of the tongues 62, 64 into the buckle 24, the divider member 348 on the pushbutton 320 initially guides the tongues along their respective paths of movement P1, P2.

If one of the tongues 62 or 64 is advanced into the cavity 82 a distance ahead of the other of the tongues 64 or 62 by more than the predetermined distance, the protrusion 282 or 284 of that tongue engages an end portion 262 or 264 of the arm 206. The arm 206 will then pivot to a variable angle W1 or W2 relative to the plunger 204 which is at least equal to the predetermined critical angle C. The variable distance S (FIG. 4A) that the innermost part of the pin portion 268 or 266 is located from the axis A is less than the fixed distance D to a respective one of the stops 228 or 226. One of the pin portions 266 or 268 engages an associated stop 226 or 228 on the projection 222 of the housing 202.

The stop 228 or 226 prevents further pivoting movement of the arm 206 and further linear movement of plunger 204 into the channel 242. The plate portions 66, 68 of the tongues 62, 64 are thus blocked from advancing the fully inserted distance into the cavity 82 in the buckle 24. When the variable distance S of the pin portion 266 or 268 is greater than the fixed distance D to the stop 226 or 228, the pin cannot engage a stop and is ineffective to block movement of the tongues 62, 64 into the cavity 82.

The one tongue 62 or 64 that is advanced ahead of the other tongue is prevented from further movement into the cavity 82 in the buckle 24. When the other of the tongues 64 or 62 is advanced the predetermined distance into the cavity 82, the other of the protrusions 284 or 282 engages the other end portion 264 or 262 of the arm 204. The other protrusion 284 or 282 pivots the arm 206 relative to the plunger 204 toward the orthagonal or neutral position and the one protrusion 282 or 284 disengages the stop 226 or 228 when the arm is pivoted to an angle C less than the predetermined central angle. The plunger 204 is permitted to move further into the channel 242 beyond the threshold distance T. The plate portions 66, 68 of the tongues 62, 64 are free to advance the fully inserted distance into the cavity 82.

When the tongues 62, 64 are inserted into the buckle 24 through the entrance opening 86, the leading end portions 162, 164 of the tongues engage the cam surfaces 146, 148 on the latch plate 100 at approximately the same time the protrusions 282, 284 engage the arm 206. As the tongues 62, 64 move into the cavity 82 in the buckle 24 along the paths of movement P1, P2, the latch plate 100 pivots in a downward or counterclockwise direction toward the base 80, as viewed in FIG. 7, about the end portion 102.

Counterclockwise pivotal movement of the latch plate 100 is resisted by the spring 104. The counterclockwise pivotal movement of the latch plate 100 occurs because the insertion forces of the tongues 62, 64 overcome the biasing force of the spring 104. The latch plate 100 continues to pivot in the counterclockwise direction as the tongues 62, 64 are advanced the predetermined distance into the cavity 82. When the tongues 64, 66 are advanced the fully inserted distance, the latch plate 100 is free to pivot in the clockwise direction.

When the latch plate 100 pivots in the clockwise direction, the latch lugs 122 and 124 are received in the respective latch openings 166 and 168 in the tongues 62 and 64, as illustrated in FIGS. 8 and 9. The end surfaces 182, 184 of the latch lugs 122, 124 engage the end surfaces 186, 188 that define the latch openings 166, 168 in the tongues 62, 64 to connect the tongues to the base 80. The shoulder belts 42 and 44 are connected with the crotch belt 46, and the child is secured from moving out of the seat 22 by the seat belt restraint system 20.

To release the tongues 62, 64 from the buckle 24, the pushbutton 320 is manually depressed to pivot in a direction toward the base 80. The pushbutton 320 pivots in a downward or counterclockwise direction (as viewed in FIGS. 5 and 6) about the axis C against the biasing force of the spring 104. The actuator lugs 326 (FIG. 5) on the pushbutton 320 engage the wing members 142, 144 on the latch plate 100 to transmit a force to pivot the latch plate counterclockwise about the axis B. The latch plate 100 pivots to its release position disengaged from the tongues 62, 64.

The latch lugs 122, 124 are removed from the latch openings 166, 168 in the tongues 62, 64, respectively, in response to the counterclockwise pivoting of the latch plate 100 to the release position. The tongues 62, 64 are then disconnected from the base 80 and can be removed or withdrawn from the cavity 82 in the buckle 24.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for use in a seat belt system, said apparatus comprising:

first and second tongues;

a base having a longitudinal axis and at least partially defining a cavity for receiving said first and second tongues, said first and second tongues being movable into the cavity along respective first and second paths of movement;

latch means supported by said base and being movable between a first position connecting said tongues with said base when said tongues move a fully inserted distance into the cavity and a second position at which said tongues may be disconnected from said base; and blocking means having a portion located in a path of movement of one of said tongues and operable for blocking insertion of said tongues into the cavity the fully inserted distance until both tongues move a predetermined distance into the cavity, said blocking means comprising:

a member supported by said base for movement relative to said base;

a pivotable arm carried by said member and having opposite end portions, each of said end portions being engageable with a respective one of said tongues, said arm pivoting relative to said member upon one of said tongues being moved the predetermined distance into the cavity without the other of said tongues being moved the predetermined distance into the cavity; and stops supported by said base for engaging one of said end portions of said arm to limit pivoting movement of said arm relative to said member and block the movement of said member relative to said base and thereby to prevent movement of only one tongue the fully inserted distance into said cavity.

2. The apparatus of claim 1 wherein each of said first and second tongues includes a plate portion and a protrusion, said plate portion cooperating with said latch means to connect said tongue with said base, said protrusion being engageable with an end portion of said arm.

3. The apparatus of claim 2 wherein said protrusion extends in a direction substantially parallel to and offset from a plane containing said plate portion.

4. The apparatus of claim 1 wherein each of the first and second paths of movement of said tongues extends in a direction substantially parallel to the longitudinal axis of said base.

5. The apparatus of claim 1 wherein said member and said arm are located at a side of said base opposite the side of said base at which said latch means is located.

6. The apparatus of claim 1 wherein said member is linearly movable in opposite directions extending substantially parallel to the longitudinal axis of said base.

7. The apparatus of claim 1 further including a housing attached to said base, said stops being formed on said housing, said housing also defining a channel for receiving said member.

8. The apparatus of claim 1 wherein the fully inserted distance that said tongues move to be connectable with said base is greater than the predetermined distance.

9. An apparatus for use in a seat belt system, said apparatus comprising:

first and second tongues;

a base having a longitudinal axis and at least partially defining a cavity for receiving said first and second tongues which are movable into the cavity along respective first and second paths of movement;

latch means supported by said base in the cavity and being movable between a first position preventing withdrawal of said tongues from the cavity and a second position permitting withdrawal of the tongues from the cavity; and blocking means having a portion located in one of said first and second paths of movement of said tongues for blocking insertion of said tongues into the cavity until both tongues are advanced together a fully inserted distance into the cavity, said blocking means comprising:

a plunger supported by said base for linear movement in a direction substantially parallel to the axis of said base as said tongues are advanced into the cavity; and a pivotable arm carried by said plunger and having opposite end portions, each of said end portions being engageable with a respective one of said tongues;

said pivotable arm having a first position relative to said plunger enabling advancement of said tongues into the cavity the fully inserted distance and a second position relative to said plunger blocking movement of said tongues into said cavity in response to one tongue being advanced into the cavity by a predetermined distance ahead of the other tongue.

10. The apparatus of claim 9 wherein each of said first and second tongues includes a plate portion and a protrusion, said plate portion cooperating with said latch means to connect said tongue with said base, said protrusion being engageable with an end portion of said pivotable arm.

11. The apparatus of claim 10 wherein said protrusion extends in a direction substantially parallel to and offset from a plane containing said plate portion.

12. The apparatus of claim 9 wherein each of the first and second paths of movement that said tongues are advanced along extends in a direction substantially parallel to the longitudinal axis of said base.

13. The apparatus of claim 9 wherein said plunger and said arm are supported by said base on a side of said base opposite the side of said base on which said latch means is located.

14. The apparatus of claim 9 further including a housing attached to said base, said housing including said stops and a channel for receiving said plunger.

15. A buckle for use in a vehicle seat belt system having a pair of tongues, said buckle comprising:

a base at least partially defining a cavity for receiving the pair of tongues which are movable into the cavity along paths of movement;

a latch plate supported by said base in the cavity and being movable between a first position connecting the tongues with said base when the tongues are moved a fully inserted distance into the cavity and a second position in which the tongues are disconnected from said base; and means for blocking movement of said tongues into the cavity until both tongues move into the cavity together a predetermined distance which is less than the fully inserted distance, said blocking means comprising:

a member supported for linear movement relative to said base;

a pivotable arm carried by said member and having portions located in the paths of movement of the tongues, opposite end portions of said arm being engageable with the tongues, said arm pivoting relative to said member if one of the tongues moves the predetermined distance into the cavity without the other of said tongues being moved the predetermined distance into said cavity; and stops for engaging one of said end portions of said arm to block linear movement of said member to prevent advancement of only one tongue the fully inserted distance into the cavity.

16. The apparatus of claim 15 wherein said member and said pivotable arm are located on a side of said base opposite the side of said base on which said latch plate is located.

17. The apparatus of claim 15 wherein said base has a planar floor portion and said member is movable in a direction substantially parallel to said planar floor portion of said base.

18. The apparatus of claim 15 further including a housing attached to said base, said housing including said stops and a channel for guiding movement of said member.

19. A buckle for use in a vehicle seat belt system having a pair of tongues, said buckle comprising:

a base at least partially defining a cavity for receiving the pair of tongues which are movable into the cavity along paths of movement;

a latch plate supported by said base and being movable between a first position connecting the tongues with said base when both tongues move a fully inserted distance into the cavity and a second position in which the tongues are disconnected from said base; and means for permitting advancement of the tongues into the cavity the fully inserted distance after both tongues advance at least a predetermined distance into the cavity substantially together, the predetermined distance being less than the fully inserted distance, said means comprising:

a member supported for linear movement relative to said base; and a pivotable arm carried by said member and having portions located in the paths of movement of the tongues, opposite end portions of said arm being engageable with the tongues, said means being ineffective to permit advancement of the tongues upon said arm pivoting relative to said member at least a predetermined angle, said arm prevented from pivoting relative to said member the predetermined angle when said tongues are moved substantially together into the cavity the predetermined distance.

* * * * *